US010902798B2

(12) United States Patent
Frederick et al.

(10) Patent No.: US 10,902,798 B2
(45) Date of Patent: Jan. 26, 2021

(54) INACTIVE STATE BACKLIGHTS

(71) Applicant: HEWLETT-PACKARD DEVELOPMENT COMPANY, L.P., Spring, TX (US)

(72) Inventors: John W Frederick, Houston, TX (US); Greg Staten, Houston, TX (US); Syed S Azam, Houston, TX (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/482,325

(22) PCT Filed: Jul. 21, 2017

(86) PCT No.: PCT/US2017/043212
§ 371 (c)(1),
(2) Date: Jul. 31, 2019

(87) PCT Pub. No.: WO2019/017959
PCT Pub. Date: Jan. 24, 2019

(65) Prior Publication Data
US 2020/0135121 A1 Apr. 30, 2020

(51) Int. Cl.
*G09G 3/34* (2006.01)
*G09G 3/36* (2006.01)

(52) U.S. Cl.
CPC ..... *G09G 3/3406* (2013.01); *G09G 3/36* (2013.01); *G09G 2330/022* (2013.01);
(Continued)

(58) Field of Classification Search
CPC ..... G09G 2330/045; G09G 2330/022; G09G 2330/026
See application file for complete search history.

(56) References Cited

U.S. PATENT DOCUMENTS 7,391,172 B2 6/2008 Ferguson et al.
7,538,498 B2 5/2009 Hur et al.
(Continued)

FOREIGN PATENT DOCUMENTS

JP 2015201120 11/2012
WO WO-2009004574 1/2009

OTHER PUBLICATIONS

Optimizing the Startup Time of Embedded Systems: a Case Study of Digital Tv, 2009.

*Primary Examiner* — Shaheda A Abdin
(74) *Attorney, Agent, or Firm* — Brooks Cameron & Huebsch PLLC

(57) ABSTRACT

Example implementations relate to inactive state backlight operation. In some examples, a system may include a display. The display may include a liquid-crystal display (LCD) panel and a backlight to illuminate the LCD panel. The system may include a computing device comprising instructions executable to disable the LCD panel from displaying a live image while the display is in an inactive state. The system may include a computing device comprising instructions executable to reduce an electrical current supplied to the backlight while the display is in the inactive state from a first amount of electrical current associated with the active state to a second amount of electrical current to cause the backlight to reach an operating condition within a targeted length of time from reentering the active state.

14 Claims, 3 Drawing Sheets

(52) U.S. Cl.
CPC . *G09G 2330/026* (2013.01); *G09G 2330/027* (2013.01); *G09G 2330/045* (2013.01)

(56) References Cited

U.S. PATENT DOCUMENTS

| | | | | |
|---|---|---|---|---|
| 9,377,648 | B2 | 6/2016 | Tetsuka et al. | |
| 2005/0270265 | A1* | 12/2005 | Plut | G06F 1/3265 345/102 |
| 2008/0007512 | A1 | 1/2008 | Honbo | |
| 2008/0152336 | A1* | 6/2008 | Hara | G03B 17/20 396/311 |
| 2010/0231502 | A1 | 9/2010 | Kondo | |
| 2010/0315574 | A1 | 12/2010 | Mizuuchi et al. | |
| 2015/0245443 | A1* | 8/2015 | Dunn | H05B 47/11 315/152 |
| 2015/0346525 | A1 | 12/2015 | Wolf et al. | |

* cited by examiner

INACTIVE STATE BACKLIGHTS

BACKGROUND

A computing device may include and/or utilize a display. A display may be an output device which displays information from the computing device as an image on the display. The display may display the information as a color image on the display. A display may generate the colors utilizing display components.

DETAILED DESCRIPTION

Figure 1:
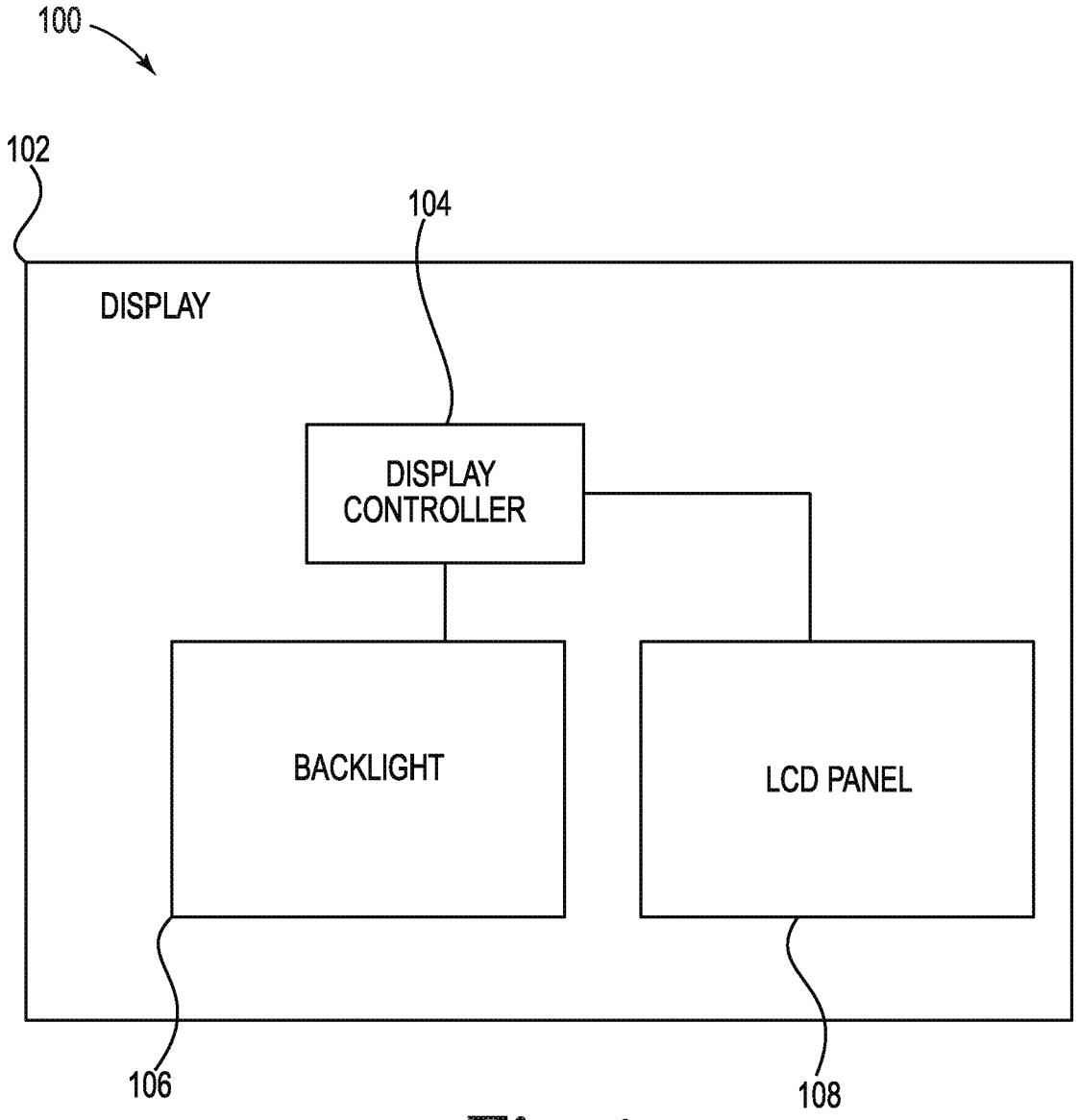
FIG. 1 illustrates an example of a system for inactive state backlight operation consistent with the disclosure.

A display may include a computer monitor. A display may be physically separate from a computing device or integrated as part of the computing device. The display may generate and/or cause an image to be displayed in pictorial form. The display may cause the image to be generated based on data from the computing device. The display may cause a color image to be displayed.

Displays may be utilized for various digital workflows. For example, displays may be employed in computing device aided digital workflows such as product design, entertainment, broadcasting, advertising, photography, print media, video production, etc. The display may produce an image of the information associated with the digital workflow. The display may provide a user with an image to visualize the subject and/or product of the workflow.

The appearance of the image produced by the display may be influenced by the characteristics of the components of the display. For example, the color and/or the brightness of the image produced by the display may be influenced by the characteristics of the constituent components of the display.

In some examples, a consistent and/or predictable appearance across a digital workflow may ensure that images appear like the ultimate subject or product. For example, a digital workflow may employ multiple devices and/or media. In an example, a digital workflow may employ a digital camera, a scanner, a computing device display, a printer, a cinema, a video, a printed product, etc. Artists, designers, technicians, and/or other users may rely on their display to produce an image that accurately reflects the appearance of a subject and/or product of a workflow in order, whether that subject and/or product is an animated film, a manufactured product, product packaging, a video, a printed advertisement etc. If a display does not accurately reflect the appearance of the subject and/or product of the workflow, then errors in the appearance of the subject and/or product may result from an incorrect understanding of the actual appearance of the subject and/or product at each stage of the workflow.

As such, some digital workflows may involve the utilization of color-sensitive displays. Color-sensitive displays may be calibrated and/or specialized displays that are configured to produce a large range of colors (e.g., over a billion distinct colors) accurately and reproducibly. While color-sensitive displays may be optimized for use in color-sensitive workflows, the appearance of the image produced on the display may vary with variation in the operating conditions of the components of the display. For example, as a display is switched on and the components begin to operate, the appearance of the image may vary. In a specific example, as a display is switched on its components will begin to warm up. As the components warm up their properties and/or characteristics may shift causing a shift in the appearance of an image on the display. Once the components of the display reach a range of operating temperatures, the appearance of the image may substantially stabilize.

Some display manufacturers recommend that users wait a period of time before using the display after turning the display on in order to allow the image it produces to stabilize. For example, some manufacturers recommend waiting up to thirty minutes from turning the display on before using the display for color-sensitive tasks such as color grading (e.g., the process of altering and enhancing the color of a motion picture, video image, and/or still image digitally). A daily thirty-minute loss of productivity is unacceptable for many users. As such, some users opt to leave their display on twenty-four hours a day and seven days a week in order to avoid the delay. Continuously running the display in this manner may reduce the operating life of the display and may unnecessarily consume electricity while the display is not being utilized by a user.

In contrast, examples of the present disclosure may include systems, methods, and machine-readable media for inactive state backlight operation consistent with the disclosure. The examples may reduce and/or eliminate the delay between turning the monitor on and achieving color stabilization, reduce electricity consumption over continuous operation, and/or preserve the operating life of the display. For example, a system may include a display. The display may include a liquid-crystal display (LCD) panel and a backlight to illuminate the LCD panel. The system may include a computing device comprising executable instructions to disable the LCD panel from displaying a live image while the display is in an inactive state. The system may include a computing device comprising executable instructions to reduce an electrical current supplied to the backlight while the display is in the inactive state from a first amount of electrical current associated with the active state to a second amount of electrical current to cause the backlight to reach an operating condition within a targeted length of time from reentering the active state.

FIG. 1 illustrates an example of a system 100 for inactive state backlight operation consistent with the disclosure. The system 100 may include a display 102. The display 102 may include a computer monitor. The display 102 may generate and/or cause an image to be displayed in pictorial form. The display 102 may cause the image to be generated based on data from the computing device. The display 102 may cause a color image to be displayed.

The display 102 may be a light-emitting diode (LED)-backlit liquid crystal display (LCD). As such, the display 100 may include an LCD panel 108. The LCD panel 108 may be an in-plane switching (IPS) LCD panel. In some examples, the LCD panel 108 may be a twisted nematic (TN) LCD panel. In other examples, the LCD panel 108 may include a vertical alignment (VA) display panel.

The display 102 may include a backlight 106. That is, the LCD panel 108 may not be self-illuminating, but may rely on illumination provided by a backlight 106 positioned behind the LCD panel 108 relative to the viewing screen.

The backlight 106 may illuminate the LCD panel 108. The backlight 106 may include a light-emitting diode (LED) backlight 106. For example, LED backlight 106 may be a white LED array or a red, green, blue (RGB) LED array behind the LCD panel 108 and/or at an edge of the LCD panel 108. The LED backlight 106 examples provided above are not limiting examples of LED configurations for a backlight 106. There are many other possible LED configurations supported in the industry.

The display 102 may operate in an off state. When a display 102 is operating in an off state the monitor may be off. The display 102 may be placed in an off state by actuating a power button on the display 102. When the display 102 is operating in an off state the power supply to the display 102 may be interrupted, reduced, and/or eliminated. The LCD panel 108 and/or the LED backlight 106 may be switched off. That is, the supply of electrical current to the LCD panel 108 and/or the LED backlight 106 may be interrupted, reduced, and/or eliminated. Substantially no electrical current may be flowing through the electrical components of the LCD panel 108 and/or the LED backlight 106 of the display 102 when it is operating in the off state. As such, the display 102 may not be displaying a live image of a graphical user interface (GUI) generated by a computing device. As used herein, a live image of a GUI may include an image that reflects a substantially real time appearance and/or changing appearance of a GUI of the computing device as it operates. A live image of the GUI may include displaying the movement of a cursor across the GUI and/or the changing graphical representations making up the GUI during operation of the computing device. A live image of the GUI may include a refreshed image of the GUI. In a refreshed image of the GUI the displayed graphical elements of the GUI may not have necessarily changed since a previous refresh of the image, but the refreshed image nonetheless may display a present appearance of the GUI being generated by the computing device.

Once the display 102 has been operating in the off state for a period of time its components such as the LCD panel 108 and/or the LED backlight 106 may cool down from an operating temperature associated with other operating states of the display (e.g., active state, standby state, etc.). Eventually, the LCD panel 108 and/or the LED backlight 106 may substantially reach an ambient temperature such as sixty-eight to seventy-seven degrees Fahrenheit. This may be referred to as a cold state.

The temperature of the components of the display 102 may influence the operating characteristics of the components. For example, as the temperature of the semiconducting element and/or junction temperature of the LEDs of the LED backlight 106 increases the operating characteristics of the LEDs may change. Specifically, as the temperature of the LEDs increases the luminance and/or color of the LEDs may change. As used herein, the luminance of the LEDs may refer to the intensity of the light emitted from a surface of the LED backlight 106 per unit area in a given direction. As used herein color may refer to an attribute of a visual perception according to which a displayed color of an area is perceived to have changed. A change in luminance and/or color associated with the light output from the LEDs may translate to a change in the displayed image.

The display 102 may operate in an active state. When a display 102 is operating in an active state the monitor may be on. The display 102 may be placed in an active state by actuating a power button on the display 102 when the display is in operating in an off state. When the display 102 is operating in an active state the power supply to the display 102 may be increased relative to the off state. When the display 102 is displaying the live image in the active state an operating electrical current may be applied. That is when the display 102 is operating in an active state the power supplied to the display 102 may be provided to the display 102 in an amount to provide an operating electrical current to operate the LCD panel 108 and the LED backlight 106 at their normal operational levels. The LCD panel 108 and/or the LED backlight 106 may be switched on. That is, the power supply to the LCD panel 108 and/or the LED backlight 106 may be varied based on the momentary power demands of the LCD panel 108 and/or the LED backlight 106, but may not be entirely removed. The operating electrical current flowing through the electrical components of the LCD panel 108 and/or the LED backlight 106 of the display 102 when it is operating in the active state may be uninterrupted and provided in an amount to display a live image of a graphical user interface (GUI) generated by a computing device. That is, when a display 102 is operating in an active state the display 102 may be producing a live and/or consistently refreshed image of the GUI generated by the operating system.

The system 100 may include a display controller 104. The display controller 104 may control the state that the display 102 is operating in and/or control the amount of current supplied to the backlight 106 and/or LCD panel 108 of the display while operating in those states. For example, the display controller 104 may control the brightness and/or the luminance level of the backlight 106 by modifying an amount of electrical current supplied to the backlight.

The display controller 104 may be integrated with the display 102 or may be separate from but in communication with the display. The display controller 104 may receive, generate, and/or operate based on pulse width modulation or analog voltage level signals to control the state that the display 102 is operating in and/or control the amount of current supplied to the backlight 106 and/or LCD panel 108 of the display while operating in those states. In some examples, the display controller 104 may include a controller dedicated to the operation of the backlight 106 and/or a controller dedicated to the operation of the LCD panel 108.

The display controller 104 may operate based on instructions. For example, the display controller 102 may utilize a processing resource to execute machine-readable instructions stored on a machine-readable media to cause the processing resource to perform actions and/or functions associated with controlling the state that the display 102 is operating in and/or controlling the amount of current supplied to the backlight 106 and/or LCD panel 108 of the display while operating in those states. In an example, the control signals and/or electrical current levels generated by the display controller 104 may be supported with a processing resource executing instructions from firmware of the display 102.

In other examples, the display controller 104 may include logic. As used herein, "logic" may be an alternative or additional processing resource to execute the actions and/or functions, etc., described herein, which includes hardware (e.g., various forms of transistor logic, application specific integrated circuits (ASICs), etc.), as opposed to computer executable instructions (e.g., software, firmware, etc.) stored in a memory and executable by a processor. It is presumed that logic similarly executes instructions for purposes of the embodiments of the present disclosure. In an example, the control signals and/or electrical current levels generated by the display controller 104 may be supported with logic.

In some examples, the display controller 104 may include a combination of logic and machine-readable instructions stored on a machine-readable media to cause a processing resource to perform actions and/or functions associated with controlling a component of the display.

The display controller 104 may switch the display 102 from operating in an active state to operating in an inactive state. As described above, the active state may include an on state with the LED backlight 106 and/or the LCD powered on and functioning within its normal operating conditions. The active state may include displaying a live image of a graphical user interface (GUI) generated by a computing device. As described above, when the display 102 is displaying the live image operating in the active state an operating electrical current may be applied. In contrast, when the display 102 is operating in an inactive state a standby electrical current may be applied. The amount of standby electrical current may be less that the amount of operating electrical current. The amount of operating electrical current and/or the amount of the standby electrical current may be determined and/or provided by the display controller 104.

The display controller 104 may disable the LCD panel 108 while the display 102 is in the inactive state. Disabling the LCD panel 108 may include eliminating a supply of electrical current to the LCD panel 108 during the inactive state. That is, disabling the LCD panel 108 may include turning off the LCD panel 108 by disrupting the supply of power to the LCD panel 108. When the power to the LCD panel 108 is turned off the LCD panel 108 may appear black. The LCD panel 108 may not be able to produce a live image of the GUI being produced by a computing device. Eliminating the power supplied to the LCD panel 108 may represent a power savings for the display 102. Further, having the LCD panel 108 off may extend the life of the components of the LCD panel 108.

In other examples, the display 102 may receive some amount of standby electrical current supplied to the LCD panel 108 in the inactive state that is less than the amount of operating electrical current supplied to the LCD panel 108 in the active state but more than zero electrical current. In other examples, the amount of standby electrical current supplied to the LCD panel 108 in the inactive state may include a portion of the amount of operating electrical current supplied to the LCD panel 108 in the active state. For example, while an IPS or VA panel 108 may appear black when they are powered off, a TN panel 108 may appear white when it is powered off. As such, disabling the LCD panel 108 may include instructing the LCD panel 108 to display a black screen. Since the LCD panel 108 may appear black in the off state, instructing the LCD panel 108 to display all black may be an operation to simulate operating the display in an off state without actually eliminating all the standby electrical current supplied to the LCD panel 108. For example, disrupting the power supply to a TN LCD panel 108 may cause the TN LCD panel 108 to display all white and with some standby electrical current still flowing through a backlight 106 the display 102 may have the appearance of being on. Therefore, instructing a TN LCD panel 108 to display all black when operating in the inactive state may utilize standby electrical current to provide the black appearance, but may give an overall appearance that the display 102 is off.

Regardless of the specific mechanism of disabling the LCD panel 108, the disabled LCD panel 108 may be disabled from displaying the live image of the GUI produced by a computing device. That is, while the display 102 is in the inactive state, the LCD panel 108 may be prevented from displaying a live image of the GUI resulting in the display 102 appearing as though it has been turned off. A user viewing the display 102 operating in the inactive state may not be able to readily distinguish the display from operating in the off state. That is, when the display 102 is operating in the inactive state, the display 102 may appear as though the LCD panel 108 and the LED backlight 106 are in the off state. Further, the display may include a state indicator signal, such as an LED indicator light visible on the surface of the display 102. The indicator light may be controlled by the display controller 104. When the display 102 is operating in an inactive state the indicator light may be switched so that it is indicating that the display is operating in an off state and/or a standby. That is, the appearance of the state indicator signal for the off state and/or standby state may be indistinguishable from the appearance of the indicator signal for the inactive state. However, the appearance of the indicator signal for the active state may be distinct from the appearance of the indicator signal for the inactive state.

The display controller 104 may modify the standby electrical current supplied to the backlight 106 relative to the active state throughout the inactive state. For example, the standby electrical current supplied to the backlight 106 may be reduced relative to the operating electrical current supplied in the active state. That is, the standby electrical current supplied to the backlight 106 in the inactive state may be reduced from a first amount of operating electrical current associated with the active state to a second amount of standby electrical current. The first amount of operating electrical current may be the amount of electrical current supplied to the backlight 106 to display the live image of the GUI in the active state. The second amount of standby electrical current may be a smaller amount of electrical current than the first amount.

The amount of the standby electrical current supplied to the display 102 when it is in an inactive state may be determined based on an amount of standby electrical current involved to cause the backlight 106 to reach an operating condition within a target length of time from reentering operating in the active state. As described above, a period of time before using some displays after turning them on (e.g., switching from operation in an off state to operation in an active state) in order to allow the operating conditions and/or the image color and luminance to stabilize may be recommended. As described above, some users may not choose to lose this productivity time. As such, the target length of time may include a length of time that the user has indicated is targeted to allow the operating conditions of the display components and/or the image color and luminance to stabilize. That is, the length of time that the user is willing to wait for the display 102 components to reach the operating conditions associated with color and luminance stability in order to utilize the display 102.

Specifically, the targeted length of time may be an amount of time that is targeted for a LED backlight 106 of the display 102 to reach an operating condition from reentering an active state. That is, the targeted length of time may define a length of time from the time that the display 102 is switched on to the active state from the inactive state to the time that the LED backlight 106 reaches an operating condition associated with color and/or luminance accuracy and stability. The operating condition may include an operating temperature of the backlight 106. As such, the targeted length of time may define the length of time from the time that the display 102 is switched on to the active state to the time that the LED backlight 106 reaches an operating temperature and/or a range of operating temperatures associated with stable luminance and/or color. Additionally, the operating condition may include a range of luminance levels and/or a range of color levels associated with an output of the LED backlight 106. The operating condition may include a range of color values associated with the live image appearing on the display 102.

In some examples, the targeted length of time may be a different amount of time than the amount of time that the LED backlight 106 takes to reach the operating condition from when the display 102 is, after a prolonged period (e.g., several hours) operating in the off state, switched from an off state to an active state. In some examples, the targeted length of time may be less than such an amount of time.

For example, a manufacturer's specification for a display 102 may recommend waiting thirty-minutes from switching from operating in an off state to operating in an active state before engaging in color-sensitive work on the display 102. However, a targeted length of time of ten-minutes may be selected.

Operating in the inactive state is different from operating in the off state and/or different from operating in the active state. During the off state the LED backlight 106 and other display 102 components may be cooling and/or moving further away from the operating conditions associated with substantially stable and accurate color and luminance levels. No electrical current may be passing through the components and the LED backlight 106 may be returning to an ambient temperature.

During the active state the LED backlight 106 and other display 102 components may be being supplied with a substantially consistent amount of operating electrical current that is utilized to display a live image of the GUI. The LED backlight 106 and other display 102 components are heating up and the operating conditions are normalizing. The LED backlight 106 and other display 102 may be moving closer to the operating conditions associated with substantially stable and accurate color and luminance levels. The operating electrical current being supplied to the backlight 106 in the active state is substantially the operating electrical current throughout operating in the active state. In the active state, the LED backlight 106 may be fully powered to manufacturer's specifications for an on and operating display 102 producing live images of the GUI.

In contrast, operating in the inactive state may include supplying the LED backlight 106 with standby electrical current. However, the amount of standby electrical current may be less than is supplied to the LED backlight 106 when the display 102 is in an active state. The amount of standby electrical current may be, for example, an amount of standby electrical current determined to keep the LED backlight 106 at a particular temperature or range of temperatures that, once the display 102 is switched to operating in an active state, will give the display enough of a "head start" on reaching the ultimately targeted operating condition at or within the ten-minute length of time.

The targeted length of time may be variable and may a user-configurable setting. A menu may be presented on the display 102 facilitating setting configuration. In some examples, the menu may be an on-screen display menu providing selectable inputs of the targeted amount of time. In other examples, the menu may include a menu, provided by the operating system GUI of a connected computing device, for accepting an input of a targeted time. For each specified targeted time, the menu may include a description of an amount of power consumption and/or power savings over leaving the display 102 operating in the active state.

The amount of standby electrical current involved in the inactive state may be determined based on laboratory measurements of the display 102 model performed by, for example, the manufacturer. For example, the LED backlight 106 temperature at each standby electrical current may be determined. The amount of time that the LED backlight 106 takes to reach various temperatures and/or operating conditions from the various LED temperatures may be determined. The relationship between the LED temperatures and the color and luminance levels of the images produced on the display 102 may be determined. As such, the amount of standby electrical current to be supplied to the LED backlight 106 in the inactive state may be based on these determinations. Additionally, a determination of an amount of drift in the luminance and/or color associated with the breakdown and/or wearing out of the LED backlight 106 components with use may be determined. Future adjustments to the standby electrical current supplied in the inactive state may be determined based on the drift determinations. As described above, many different types of LED configurations for backlights are supported in the industry. The examples provided herein are suitable for the many different types as the amount of standby electrical current involved in the inactive state may be tailored to each LED configuration by testing of a specific configuration to determine the relationship between the operating characteristics of the specific LED configuration and the corresponding effect on the displayed color and luminance.

In an example, the display controller 104 may keep the LED backlight 106 of the display 102 at a substantially stable temperature during the inactive state. The LED backlight 106 of the display 102 may be kept at the substantially stable standby temperature throughout the duration of the inactive state by supplying the LED backlight 106 with the determined amount of standby electrical current throughout the duration of the inactive state. The amount of standby electrical current supplied and/or the targeted stable inactive state temperature of the LED backlight 106 may be less than the operating electrical current supplied and/or the operating temperature of the LED backlight 106 when the display 102 is operating in the active state. The standby electrical current may be the amount of electrical current determined to achieve the stable inactive state temperature that will allow the LED backlight 106 to reach the operating condition substantially at the specified targeted time. That is, the standby electrical current supplied may not be more than is involved with achieving the specified target time since the standby electrical current amount may represent a balance between power conservation over running the display 102 in an active state twenty-four hours a day and achieving sub-manufacturer specified warmup times for color-sensitive work on the display 102.

In another example, the standby electrical current supplied to the LED backlight 106 during the inactive state may not be supplied immediately upon switching the display 102 to operating in an inactive state. That is, the standby electrical current may not be supplied to the LED backlight 106 in the inactive state until the display 102 has been in the inactive state for a length of time. Alternatively, the standby electrical current may be supplied to the LED backlight 106 immediately upon the display 102 entering the inactive state, but the display 102 may not enter the inactive state until the display 102 has been in an off state for a length of time.

For example, when a display controller 104 causes the display 102 to first exit operation in the active state and enter operation in the off state or in the inactive state without electrical current supplied to the LED back light, the LED backlight 106 will still have a residual elevated temperature. The residual heat associated with LED backlight 106 will dissipate to the point that the LED reaches an ambient temperature over a period of time. Applying standby electrical current to the LED backlight 106 during this cool down period while the LED backlight 106 may be at a temperature above the targeted stable inactive state temperature may result in retaining the LED backlight 106 at a temperature above the targeted stable inactive state temperature. As such, the LED backlight 106 may be consuming more power than is involved in achieving and maintaining the targeted stable state temperature and the LED backlight 106 may reach the targeted operating conditions before the target length of time from reentering the active state. Therefore, the LED backlight 106 may be over-consuming power and subjecting the LED backlight 106 to superfluous wear and tear by supplying standby electrical current to the LED backlight 106 longer than needed to achieve the targeted length of time.

As such, display controller 104 may adjust the amount of standby electrical current and/or the timing of the application of standby electrical current supplied to the LED backlight 106 in the inactive stage based on the length of time that the display 102 has been operating in an off state and/or an inactive state. For example, the amount of standby electrical current supplied to the LED backlight 106 may be gradually increased up to the amount of standby electrical current determined to achieve the targeted stable inactive state temperature of the LED backlight 106 as the time elapsed since the display has been operating in the inactive state and/or off state increases. In some examples, the standby electrical current may not be supplied to the LED backlight 106 in the inactive state until the display 102 has been operating in an inactive state and/or an off state for a period of time (e.g., two hours).

In some examples. The display controller 104 may adjust the amount of operating electrical current and/or the timing of the application of operating electrical current supplied to the LED backlight 106 throughout its operation in the active state. For example, in response to the display 102 entering the active state, the backlight 106 may be supplied with a first amount of operating electrical current for a first portion of the active state. The backlight 106 may then be supplied with a second amount of operating electrical current for the second portion of the active state. The first amount of operating electrical current may be a larger amount of operating electrical current than the second amount of operating electrical current. As such, the first portion of the active state may correspond to an accelerated component warmup phase. For example, the first portion of the active state may include a period of time that the backlight 106 is being heated from the temperature maintained during the inactive state to the operating temperature. The backlight 106 may be heated during this period by supplying the backlight 106 with an amount of operating electrical current that is greater than an amount of operating electrical current that the backlight 106 will be supplied throughout the active state in producing a live image of the GUI. That is, the backlight 106 may be heated during this period by an amount of operating electrical current that exceeds the amount that will be supplied for its operation in the active state but does not exceed the operating electrical current limit associated with the backlight 106 components.

Figure 2:
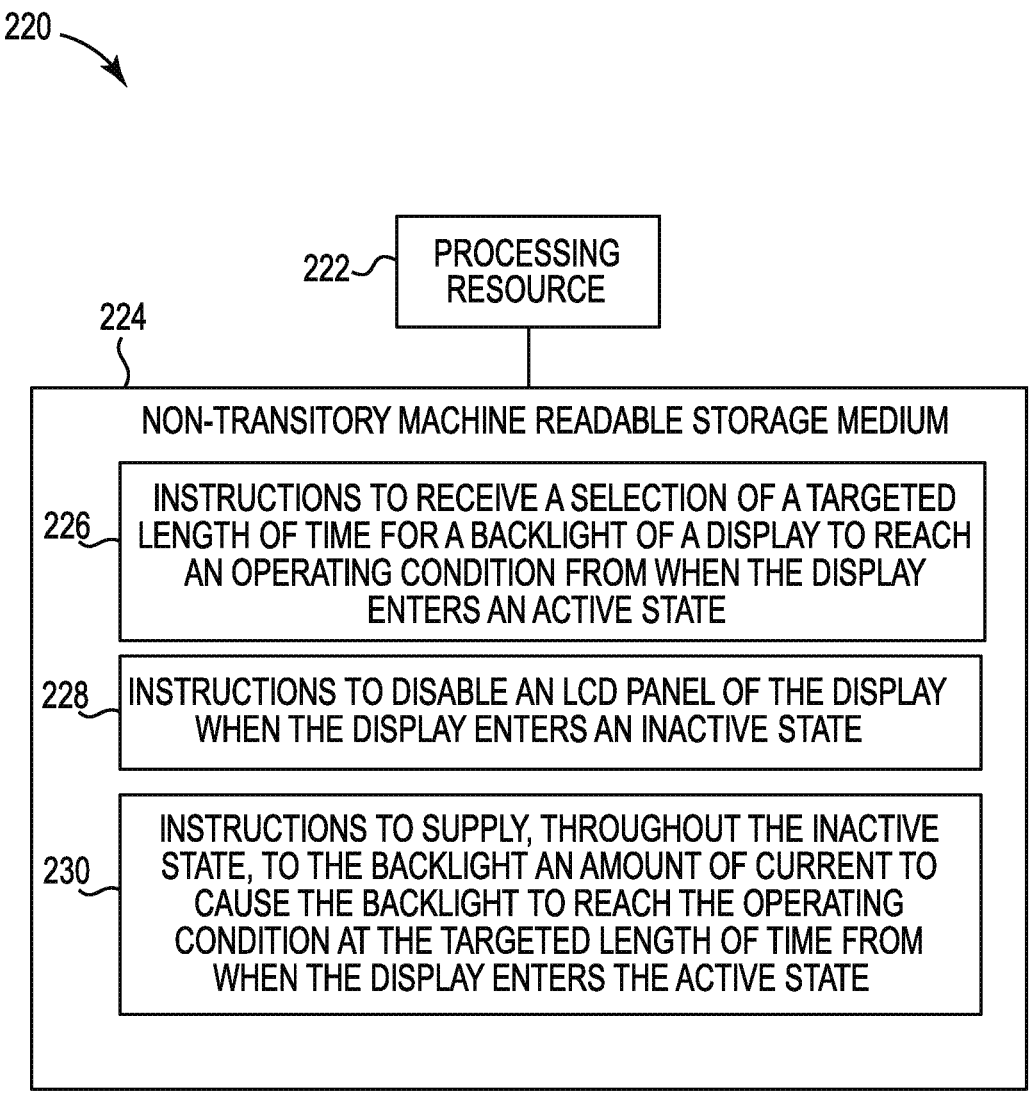
FIG. 2 illustrates a diagram of an example of a processing resource and a non-transitory computer readable medium for inactive state backlight operation consistent with the disclosure.

FIG. 2 illustrates a diagram 220 of an example of a processing resource 222 and a non-transitory machine readable medium 224 for inactive state backlight operation consistent with the disclosure. A memory resource, such as the non-transitory machine readable medium 224, may be used to store instructions (e.g., 226, 228, 230) executed by the processing resource 222 to perform the operations as described herein. A processing resource 222 may execute the instructions stored on the non-transitory machine readable medium 224. The non-transitory machine readable medium 224 may be any type of volatile or non-volatile memory or storage, such as random access memory (RAM), flash memory, read-only memory (ROM), storage volumes, a hard disk, or a combination thereof.

The example medium 224 may store instructions 226 executable by the processing resource 222 to receive a selection of a targeted length of time. The targeted length of time may be a length of time for a backlight of a display to reach an operating condition starting from when the display enters an active state.

The selection may be received from inputs to a menu provided on the display. The menu may be an on-screen display menu or a menu generated by the operating system of a connected computing device. The menu may provide an interface to accept a user's specification of the targeted length of time. The menu may additionally include a control to enable or disable the operation of the display in the inactive state. That is, the menu may include an adjustable control to enable or disable the ability of the display to enter the inactive state. When the ability of the display to enter the inactive state is disabled, the display may simply operate in the off state when it is not operating in the active state.

Moreover, the menu may include a description of a power savings amount associated with the received targeted amount of time. For example, the menu may include a difference in power consumption associated with operating the display in an inactive state versus operating the display in an active state for a period of time. The difference may be expressed as a percent increase or decrease in efficiency between the two operating states. Additionally, the menu may include a difference in power consumption associated with operating the display in an inactive state versus operating the display in an off state for a period of time.

The example medium 224 may store instructions 228 executable by the processing resource 222 to disable an LCD panel of the display when the display enters an inactive state. While the display is operating in the active state the LCD panel may be enabled and receiving operating electrical current and instructions to cause a live image of the GUI to be displayed. For example, in the active state the pixels of the LCD panel may have electrical fields applied, modified, and/or refreshed in order to filter backlight n a manner that produces a live image of a GUI of a computing device.

In examples where the operation of a display in the inactive state has been enabled, the LCD panel that is enabled in the active state may be disabled upon entering the inactive state. If the display is transitioning from the active state to the inactive state, disabling the LCD panel may include shutting off the supply of electrical current to the LCD panel and/or instructing, via the application and/or elimination of electrical fields, the pixels of the LCD panel to filter out the LED backlight in order to display a black screen. If the display is transitioning from the off state to an inactive state, disabling the LCD panel may include continuing not to supply the LCD panel with standby electrical current or starting the supply of standby electrical current to the LCD panel along with the instructions to display a black screen. Either way, disabling the LCD panel may include disrupting the ability, instructions, and/or standby electrical current to the LCD panel that would cause the LCD panel to display a live image of the GUI. The disabled LCD panel may be limited to utilization in displaying a black screen with no live image of the GUI.

The example medium 224 may store instructions 230 executable by the processing resource 222 to supply the backlight with an amount of standby electrical current throughout the inactive state. The amount of standby electrical current supplied to the backlight may be determined based on a targeted length of time for the backlight to reach an operating condition from when the display enters the active state. The amount of standby electrical current supplied to the backlight throughout the inactive state may be the amount to cause the backlight to reach the operating condition at the targeted length of time from when the display enters the active state.

For example, the amount of standby electrical current supplied to the backlight may be an amount of standby electrical current that will achieve and/or preserve a target inactive state temperature of the LED backlight during the inactive state. The target inactive state temperature may be a laboratory-defined temperature that is higher than the ambient temperature and lower than the operating temperature in the active state. The target inactive state temperature may be a temperature starting point of the LED backlight upon entering the active state from which the operating condition of the LED backlight may be reached at the targeted length of time with the active state levels of operating electrical current are supplied to the LED backlight.

The amount of standby electrical current supplied to the backlight throughout the inactive state may be less than the amount of operating electrical current supplied to the backlight in an active state. The temperature of the LED backlight in the inactive state may be lower than the temperature of the LED backlight in the active state. Operating the LED backlight in the inactive state may produce a power savings over operating the LED backlight in the active state.

The amount of standby electrical current supplied to the LED backlight throughout the inactive state may be adjusted. For example, the amount of standby electrical current to cause the backlight to reach the operating condition at the targeted length of time from entering the active state throughout the inactive state may be adjusted based on the properties and/or operation of the display. For example, the amount of standby electrical current may be adjusted based on the amount of time that the display has been operating in the inactive state. That is, when the display enters the inactive state the LED backlight may be supplied with a first amount of standby electrical current. That first amount of standby electrical current may be no standby electrical current or a small, nonzero amount of standby electrical current relative to the amount of standby electrical current involved in raising the LED backlight from an ambient temperature to a targeted inactive state temperature. The first amount of standby electrical current may be no standby electrical current or a relatively small amount of standby electrical current since the LED backlight may be assumed to still be near an operating condition due to the residual heat of the LED backlight resulting from operation in the active state. As the amount of time operating in the inactive state increases it may be assumed that the LED backlight temperature is returning to an ambient temperature and the amount of standby electrical current supplied to the LED backlight in the remaining portion of the inactive state may be increased to achieve and/or maintain a targeted inactive state temperature.

In some examples, a temperature sensor may be utilized to detect the ambient temperature of the environment that the display is in. The temperature data for the display environment may then be utilized to offset the amount of standby electrical current applied to the backlight in the inactive state. For example, if the ambient temperature of the environment is higher than the temperatures under which the amount of standby electrical current to achieve a backlight operating temperature within a target time by more than ten degrees Fahrenheit, the amount of standby electrical current applied to the backlight in the inactive state may be reduced relative to a laboratory determined amount involved in achieving the operating temperature.

In some examples, the amount of electrical current supplied to the backlight during the duration of the active state may be varied. For example, the amount of electrical current supplied to the backlight during the active state may be adjusted to accelerate a warmup process of the backlight components. For example, in response to the display entering the active state, the backlight may be supplied with a first amount of operating electrical current for a first portion of the active state. The backlight may be supplied with a second amount of operating electrical current for the second portion of the active state. The first amount of operating electrical current may be a larger amount of operating electrical current than the second amount of operating electrical current. As such, the first portion of the active state may correspond to an accelerated component warmup phase. For example, the first portion of the active state may include a period of time that the backlight is being heated from the temperature maintained during the inactive state to the operating temperature. The backlight may be heated during this period by supplying the backlight with an amount of operating electrical current that is greater than an amount of operating electrical current that the backlight will be supplied throughout the active state in producing a live image of the GUI. That is, the backlight may be heated during this period by an amount of operating electrical current that exceeds the amount that will be supplied for its operation in the active state but does not exceed the operating electrical current limit associated with the backlight components.

Figure 3:
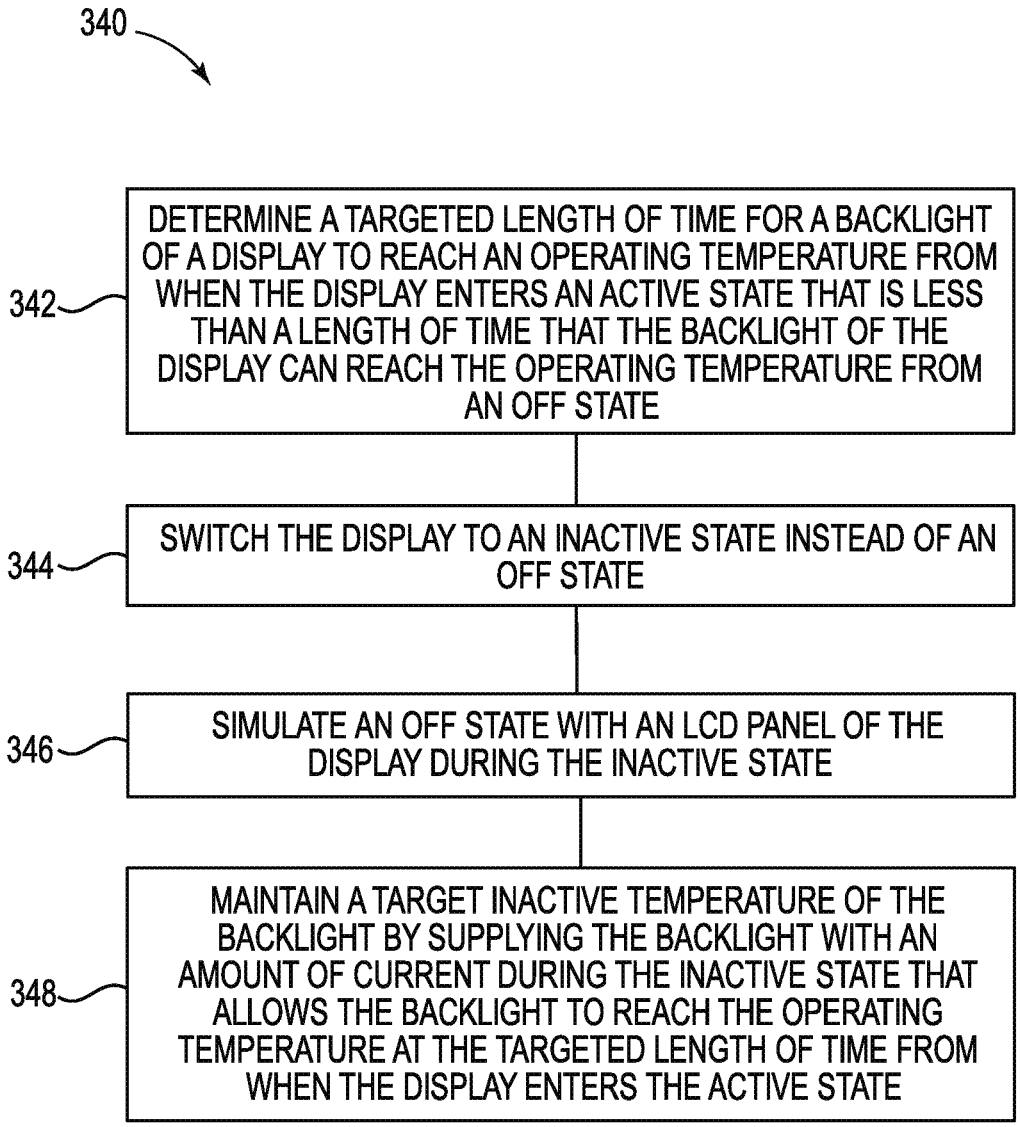
FIG. 3 illustrates a flow diagram of an example of a method for inactive state backlight operation consistent with the disclosure.

FIG. 3 illustrates a flow diagram of an example of a method 340 for inactive state backlight operation consistent with the disclosure. At 342, the method 340 may include determining a targeted length of time for a backlight of a display to reach an operating temperature from when the display enters an active state. The targeted length of time may be less than a length of time that the backlight of the display is able, while operating in the active state with an active state operating electrical current supply, to reach the operating temperature from an off state. That is, the targeted length of time may represent a shorter delay in utilizing the display for color-sensitive work than would result from turning the display on into an active state from an off state and waiting for the backlight to reach the operating temperature.

At 344, the method 340 may include switching the display to an inactive state instead of an off state. For example, when an instruction is issued to switch the display off (e.g., by actuation of a power button on the monitor, by detecting a period of inactivity at a computing device, by detecting a lack of an input from a computing device, etc.) the display may instead be switched into an inactive state. There may be no indication to a user that the monitor is in an inactive state as opposed to an off state. Alternatively, a signal may be generated that signals the display is in an inactive state (e.g., such as turning on an indicator light on the display, causing an indicator light on the display to flash with a particular pattern, causing an indicator light on the display to emit a specific color) as opposed to an off state.

At 346, the method 340 may include simulating an off state with an LCD panel of the display during the inactive state. Simulating the off state may include disabling the LCD panel. For example, the standby electrical current supply to the LCD panel may be disrupted and/or the LCD panel may be configured to substantially block light from a backlight by displaying all black. Disabling the LCD panel may include shutting off the LCD panel such that it is no longer displaying a live image of the GUI if a connected computing device. Disabling the LCD panel may include preventing the LCD panel from drawing standby electrical current during the inactive state.

Simulating the off state may also include making the display appear as though it is operating in an off state. As described above, disabling the LCD panel may result in a display screen that is black and therefore had an appearance substantially similar to the appearance of a display operating in an off state. In addition, indicator signals on the display may be altered so that they signal to a user that the display is in the off state.

At 348, the method 340 may include maintaining a target inactive temperature of the backlight. The target inactive temperature of the backlight may be a temperature range of the LED components of a backlight during the inactive state. The temperature range may be achieved and/or maintained by supplying the backlight with an amount of standby electrical current during the inactive state. The amount of standby electrical current may be determined as the amount of standby electrical current that will enable the backlight to achieve, during operation of the display in the active state, an operating temperature at the targeted length of time from when the display reenters the active state. That is, the amount of standby electrical current may be an amount of standby electrical current that keeps the backlight preheated to a temperature range that, when used as a starting point in active state operation, allows the backlight components to reach a targeted active state temperature at the targeted length of time after the display enters the active state.

In response to the display entering the active state, the backlight may be supplied with a first amount of operating electrical current for a first portion of the active state. The backlight may be supplied with a second amount of operating electrical current for the second portion of the active state. The first amount of operating electrical current may be a larger amount of operating electrical current than the second amount of operating electrical current. As such, the first portion of the active state may correspond to an accelerated component warmup phase. For example, the first portion of the active state may include a period of time that the backlight is being heated from the temperature maintained during the inactive state to the operating temperature. The backlight may be heated during this period by supplying the backlight with an amount of operating electrical current that is greater than an amount of operating electrical current that the backlight will be supplied throughout the active state in producing a live image of the GUI. That is, the backlight may be heated during this period by an amount of operating electrical current that exceeds the amount that will be supplied for its operation in the active state but does not exceed the operating electrical current limit associated with the backlight components.

The display may include a signaling device. For example, the display may include LED indicators lights that may signal an operating state of the display and/or an operating condition of the display and/or the LED backlight. In response to the display entering the active state the display may signal that the backlight has not yet reached the operating temperature. For example, the display may illuminate an LED in a yellow color warning a user that, while the display is producing a live image of the GUI, the operating temperature of the backlight has not yet been reached and the color and/or luminance may shift from its present value. However, in response to the elapsing of the targeted amount of time from when the display entered the active state, the display may signal that the backlight has reached the operating temperature. For example, the display may illuminate an LED in a green color to signal that the monitor is ready for color sensitive work since the color and/or luminance values are substantially stabilized.

In the foregoing detailed description of the disclosure, reference is made to the accompanying drawings that form a part hereof, and in which is shown by way of illustration how examples of the disclosure may be practiced. These examples are described in sufficient detail to enable those of ordinary skill in the art to practice the examples of this disclosure, and it is to be understood that other examples may be utilized and that process, electrical, and/or structural changes may be made without departing from the scope of the disclosure. A "plurality of" is intended to refer to more than one of such things.

The figures herein follow a numbering convention in which the first digit corresponds to the drawing figure number and the remaining digits identify an element or component in the drawing. For example, reference numeral 102 may refer to element "02" in FIG. 1 and an analogous element may be identified by reference numeral 202 in FIG. 2. Elements shown in the various figures herein can be added, exchanged, and/or eliminated so as to provide a number of additional examples of the disclosure. In addition, the proportion and the relative scale of the elements provided in the figures are intended to illustrate the examples of the disclosure, and should not be taken in a limiting sense.

What is claimed:

1. A system comprising:

a display comprising:

a liquid-crystal display (LCD) panel;

a backlight to illuminate the LCD panel; and a computing device comprising executable instructions to:

disable the LCD panel from displaying a live image while the display is in an inactive state;

reduce an electrical current supplied to the backlight while the display is in the inactive state from a first amount of electrical current, associated with a range of luminance levels of the backlight in the active state to produce a color stabilized appearance of the live image on the display in the active state, to a second amount of electrical current, selected to maintain a range of luminance levels of the backlight in the inactive state above a range of luminance levels of the backlight in an off state and below the range of luminance levels of the backlight in the active state, to cause the backlight to reach the range of luminance levels of the backlight in the active state within a targeted length of time from reentering the active state; and wherein the off state includes an elimination of a supply of electrical current to the LCD panel and an elimination of a supply of electrical current to the backlight during the off state.

2. The system of claim 1, including executable instructions to eliminate a supply of electrical current to the LCD panel during the inactive state to disable the LCD panel.

3. The system of claim 1, including executable instructions to instruct the LCD panel to display a black screen to disable the LCD panel.

4. The system of claim 1, wherein the display includes a state indicator signal, wherein to operate in the inactive state includes to switch the state indicator signal to indicate that the display is in an off state.

5. The system of claim 1, wherein the first amount of electrical current is associated with an operational temperature of the backlight in the active state to produce the color stabilized appearance of the live image on the display in the active state, and wherein an application of the second amount of electrical current maintains an operational temperature of the backlight in the inactive state above an operational temperature of the backlight in an off state and below the operational temperature of the backlight in the active state resulting from the application of the first amount of electrical current.

6. The system of claim 1, wherein the first amount of electrical current is associated with a range of color values in the active state associated with the live image appearing on the display and to produce the color stabilized appearance of the live image on the display in the active state, and wherein an application of the second amount of electrical current maintains a range of color values in the inactive state above a range of color values in an off state and below the range of color values in the active state resulting from the application of the first amount of electrical current.

7. A non-transitory computer-readable medium containing instructions executable by a processor to cause the processor to:

receive a selection of a targeted length of time for a backlight of a display to reach a range of luminance levels of the backlight in the active state from when the display enters an active state, wherein the range of luminance levels of the backlight in the active state, once reached, produce color and luminance stability for images displayed on the display throughout the active state;

disable a liquid crystal display (LCD) panel of the display when the display enters an inactive state; and supply, throughout the inactive state, to the backlight an amount of electrical current to cause the backlight to reach the range of luminance levels at the targeted length of time from when the display enters the active state, wherein the amount of electrical current is an amount selected to maintain a range of luminance levels of the backlight in the inactive state above a range of luminance levels of the backlight in an off state and below the range of luminance levels of the backlight in the active state, and wherein the off state includes an elimination of a supply of electrical current to the LCD panel and an elimination of a supply of electrical current to the backlight during the off state.

8. The non-transitory computer-readable medium of claim 7, including instructions executable by the processor to provide a menu including:

a control to enable and disable an ability of the display to enter the inactive state; and a description of a power savings amount associated with the targeted length of time.

9. The non-transitory computer-readable medium of claim 7, wherein the amount of electrical current supplied to the backlight throughout the inactive state is less that an amount of electrical current supplied to the backlight in an active state.

10. The non-transitory computer-readable medium of claim 7, including instructions executable by the processor to adjust the amount of electrical current to cause the backlight to reach the range of luminance levels at the targeted length of time from entering the active state throughout the inactive state based on an amount of time that the display has been operating in the inactive state.

11. A method comprising:

determining a targeted length of time for a backlight of a display to reach an operating temperature from when the display enters an active state that is less than a length of time that the backlight of the display can reach the operating temperature from an off state, wherein the operating temperature, once reached, produces color and luminance stability and accuracy for images on the display throughout the active state;

switching the display to an inactive state instead of an off state;

simulating an off state with a liquid crystal display (LCD) panel of the display during the inactive state; and maintaining a target inactive temperature of the backlight by supplying the backlight with an amount of electrical current during the inactive state that allows the backlight to increase to the operating temperature at the targeted length of time from when the display enters the active state, wherein the amount of electrical current supplied during the inactive state is selected to maintain the target inactive temperature of the backlight in the inactive state above a temperature of the backlight in an off state and below the operating temperature of the backlight in the active state, and wherein the off state includes an elimination of a supply of electrical current to the LCD panel and an elimination of a supply of electrical current to the backlight during the off state.

12. The method of claim 11, further comprising supplying, in response to the display entering the active state, the backlight with a first amount of electrical current for a first portion of the active state and supplying the backlight with a second amount of electrical current for a second portion of the active state, wherein the first amount of electrical current is greater than the second amount of electrical current and wherein the first portion of the active state corresponds to a period of time that the backlight is being heated from the temperature maintained during the inactive state to the operating temperature.

13. The method of claim 11, further comprising signaling, in response to the display entering the active state, that the backlight has not yet reached the operating temperature.

14. The method of claim 13, further comprising signaling, in response to an elapsing of the targeted length of time from when the display entered the active state, that the backlight has reached the operating temperature.

* * * * *